US011805832B2

(12) United States Patent
Boland et al.

(10) Patent No.: US 11,805,832 B2
(45) Date of Patent: Nov. 7, 2023

(54) REMOVABLE EXPANDABLE SEMIRIGID CUMMERBUND

(71) Applicant: Ferro Concepts Inc., Calgary (CA)

(72) Inventors: Riley Boland, Calgary (CA); Tyrell Thibeault, Calgary (CA)

( * ) Notice: Subject to any disclaimer, the term of this patent is extended or adjusted under 35 U.S.C. 154(b) by 182 days.

(21) Appl. No.: 17/023,221

(22) Filed: Sep. 16, 2020

(65) Prior Publication Data

US 2022/0079277 A1 Mar. 17, 2022

(51) Int. Cl.
*A41F 9/00* (2006.01)
*A41F 9/02* (2006.01)

(52) U.S. Cl.
CPC ..... *A41F 9/002* (2013.01); *A41F 9/025* (2013.01)

(58) Field of Classification Search
CPC ..... A41F 9/002; A41F 9/025
See application file for complete search history.

(56) References Cited

U.S. PATENT DOCUMENTS 2,442,855 A * 6/1948 Luftig ..... A44B 11/008 2/322
2,914,070 A 11/1959 Kellner et al.
4,990,115 A 2/1991 Vorhauer et al.
5,011,334 A * 4/1991 Vorhauer ..... B63C 11/08 2/16
5,241,704 A * 9/1993 Sydor ..... A61F 5/028 128/876
2009/0320182 A1 12/2009 Schmalz et al.
2012/0084906 A1* 4/2012 Sego, Jr. ..... F41H 1/02 2/463
2015/0282546 A1 10/2015 Silva
2019/0154404 A1* 5/2019 LeMarbe ..... F41H 1/02

* cited by examiner

*Primary Examiner* — Khaled Annis

(57) ABSTRACT

An expandable semirigid cummerbund for removable attaching to an object, such as tactical or outdoor equipment, to be carried in a manner that secures the object to a wearer's waist, the cummerbund comprising two segments wherein each segment comprises: an attachment member having a first side panel and an opposite second side panel that is connected to the first side panel to define a pocket between said side panels with an open end and an opposite closed end; a semirigid belt portion with an end slidably received within the pocket; an elastic member connecting the enclosed end of the belt to the closed end of the pocket and that expands in response to a pulling force on the belt portion to permit partial extraction of the end of the belt portion from the pocket, and to contract on withdrawal of the pulling force to pull the end back into the pocket; and a first connector on an outward facing surface of the first side panel operable to removably connect the attachment member to the object.

6 Claims, 3 Drawing Sheets

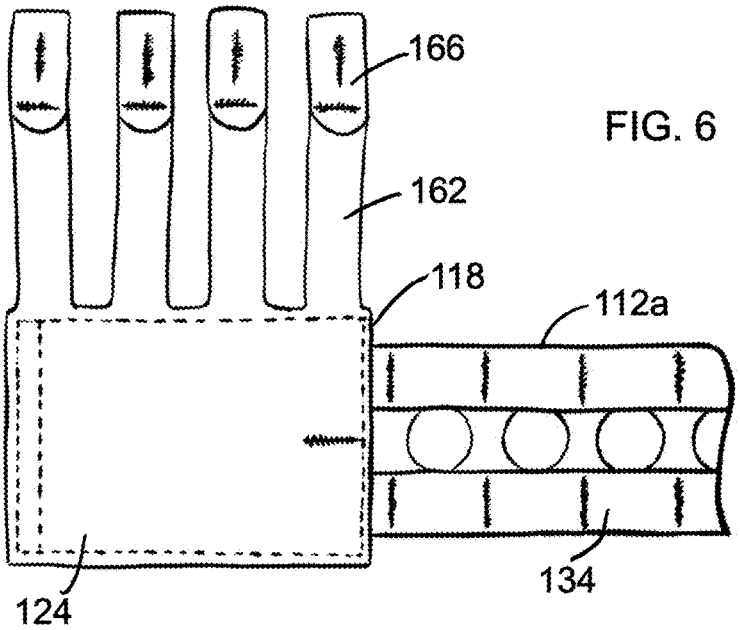
FIG. 6
FIG. 8
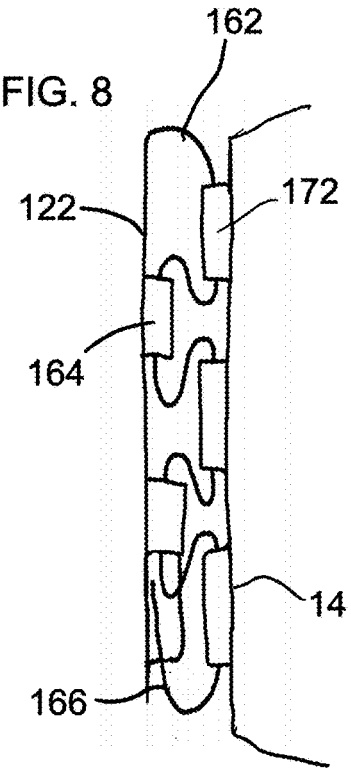
FIG. 7
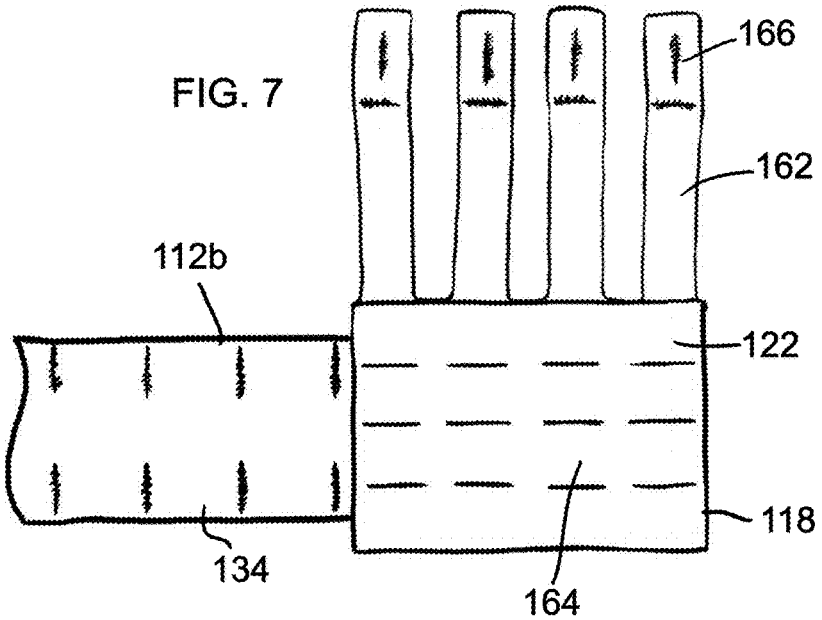

REMOVABLE EXPANDABLE SEMIRIGID CUMMERBUND

BACKGROUND OF THE INVENTION

1. Field of Invention

This invention relates to cummerbunds and in particular to a removable longitudinally expandable semirigid cummerbund particularly suited for use with tactical or outdoor equipment.

2. Description of Related Art

Cummerbunds for use on outdoor or tactical equipment to secure such equipment around a user's waist are known in these fields of art. Typically the cummerbund is of a material fabric that provides some flexibility to accommodate changes in the user's waist in response to movement of the user, but are generally too flexible to provide support for additional equipment attached to or suspended from the cummerbund itself. Such prior art cummerbunds tend to sag under the weight of such additional equipment. An object of the invention is to address the above and other shortcomings.

SUMMARY

The above shortcomings may be addressed by providing, in accordance with one aspect of the invention, an expandable semirigid cummerbund for removable attaching to an object to be carried in a manner that secures the object to a wearer's waist, the cummerbund comprising two segments wherein each segment comprises: an attachment member having a first side panel and an opposite second side panel that is connected to the first side panel to define a pocket between said side panels, the pocket includes an open end and an opposite closed end; a semirigid belt portion having an enclosed end slidably received within the pocket in a manner that a body of the belt portion extends out of the open end of the pocket; an elastic member connecting the enclosed end of the belt portion to the closed end of the pocket, wherein the elastic member expands in response to a pulling force applied to the belt portion to permit partial extraction of the enclosed end of the belt portion from the pocket, and to contract on withdrawal of the pulling force to pull the enclosed end back into the pocket; and a first connector on an outward facing surface of the first side panel operable to removably connect the attachment member to the object.

In some embodiments, the attachment member may comprise a fabric pouch, and the elastic member is stitched to both the enclosed end of the belt portion and the closed end of the pocket.

In some embodiments of the cummerbund, the belt portion may further comprise a terminal end remote from the enclosed end that may include a terminal end connector operable to connect to the terminal end connector of the other segment in a manner that allows the belt portions of both segments to extend around the wearer's waist. In some embodiments, the terminal end connector comprises one or both of hooks and loops of a hook and loop fastener. In some embodiments, the terminal end connectors of both segments together comprise a buckle.

In some embodiments, the first connector may comprise a strap mechanism.

In some embodiments, the first connector may comprise one hooks and loops of a hook and loop fastener.

In some embodiments, the cummerbund may further comprise a second connector on an outward facing surface of the second side panel wherein the second connector comprises one of hooks and loops of a hook and loop fastener. In some embodiments, the second connector is a counterpart to the first connector.

In accordance with another aspect of the invention, there is provided a backpack, vest or body armor having a cummerbund of the present invention.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention:

FIG. 6 is a close up partial view from a side of another embodiment of a cummerbund segment showing a connector having a webbing strap attachment;

FIG. 7 is a close up partial view from the other side of the cummerbund segment in FIG. 6; and FIG. 8 is a close up partial section view showing the attachment of the connector of the cummerbund segment of FIG. 6 of the pouch onto complementary webbing loop arrangement on the object.

DETAILED DESCRIPTION

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Figure 1:
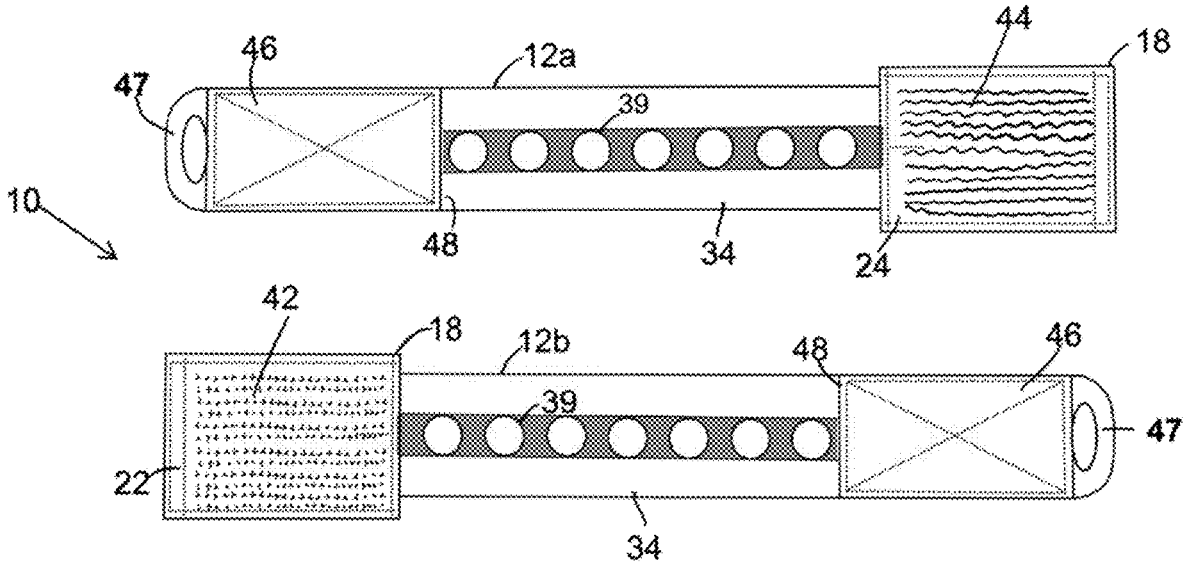
FIG. 1 is a side view of a removable longitudinally expandable semirigid cummerbund according to an embodiment of the invention.
Figure 2:
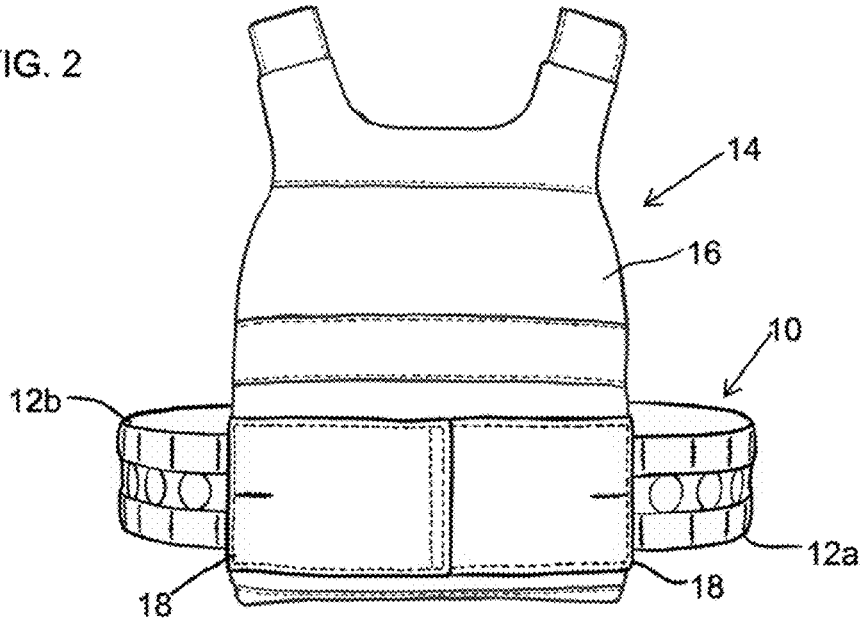
FIG. 2 is a view of the cummerbund of FIG. 1 shown attached to an object such as a tactical vest.
Figure 3:
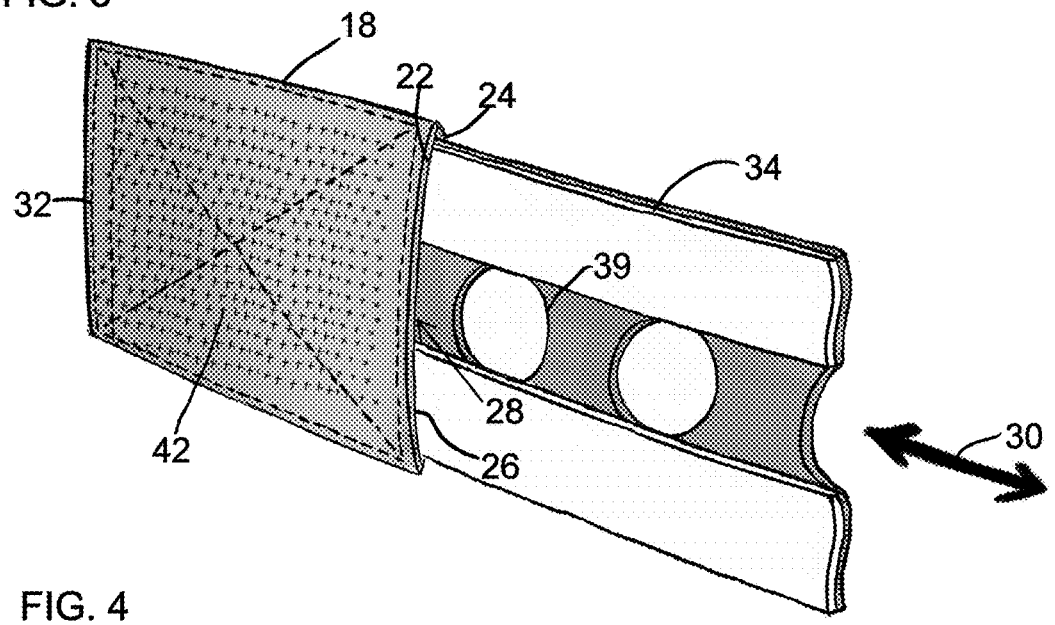
FIG. 3 is a perspective close up partial view of the pouch and enclosed end of a cummerbund segment of cummerbund of FIG. 1.
Figure 4:
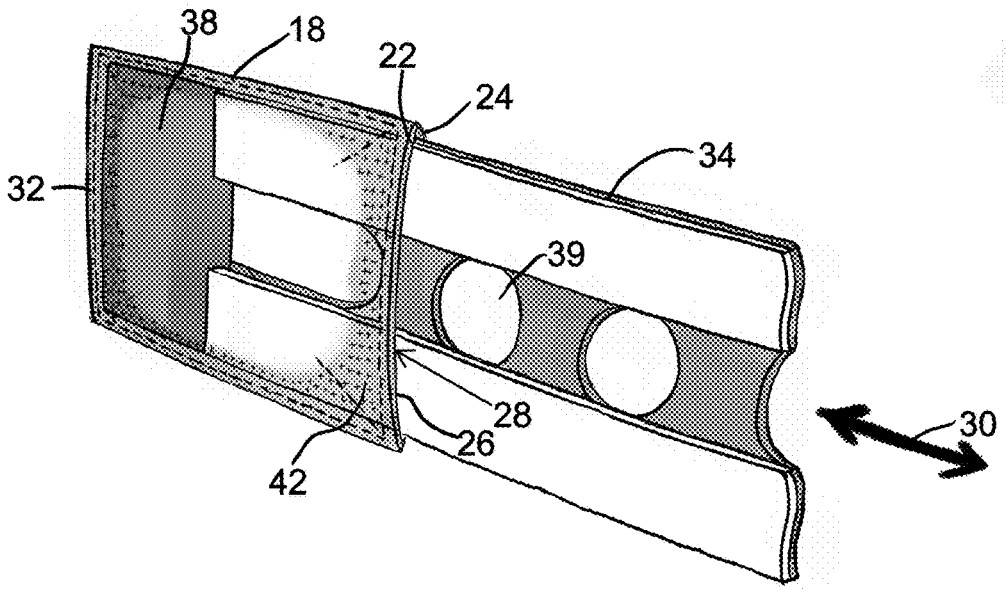
FIG. 4 is a perspective close up partial view of the inside of the pouch and enclosed end of a cummerbund segment of cummerbund of FIG. 1 with the first side panel shown in phantom.
Figure 5:
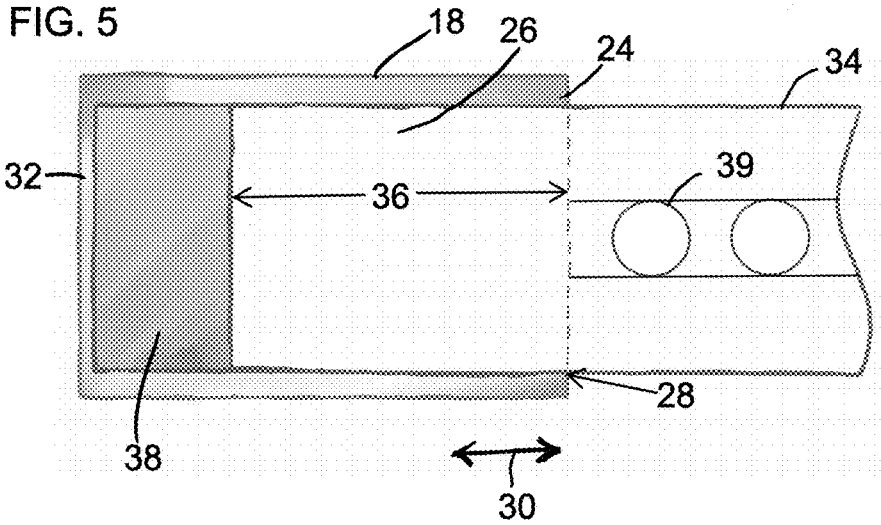
FIG. 5 is a close up partial side view with the first side panel removed showing the inside of the pouch and the enclosed end of the semirigid belt portion and the elastic member of a cummerbund segment of the cummerbund of FIG. 1.

Referring to FIG. 1, a removable longitudinally expandable semirigid cummerbund according to a first embodiment of the invention is shown generally at 10. The cummerbund 10 removable attaches an object to be carried in a manner that secures the object 14 to a wearer's waist. The cummerbund 10 is particularly well suited for use with tactical or outdoor equipment such as for example tactical vest 16 (by way of an example only of one kind of object 14) in the embodiment illustrated in FIG. 2.

Cummerbund 10 comprises two segments 12*a* and 12*b* that cooperate with each other to secure the object to a wearer's waist and are structurally similar insofar as the inventive subject matter; however, it is contemplated that additional add on structures may be provided on one segment that may not be mirrored on the other segment. Segments 12*a* and 12*b* are collectively referred as cummerbund segment 12 herein.

Each cummerbund segment 12 comprises an attachment member such as fabric pouch 18 having a first side panel 22 and an opposite second side panel 24 that is connected to the first side panel 22 to define a pocket 26 between said side panels. Pocket 26 includes an open end 28 and an opposite closed end 32. Preferably pouch 18 is constructed of a durable nylon or nylon blend fabric material such as a cordura fabric. Fabric is preferred for the pouch 18 because it enables a thin profile for the pouch which is advantageous when the cummerbund 10 is worn on the inside of the object 14. However, the attachment member may be made from other materials as would be apparent to the skilled reader in light of the present disclosure.

Cummerbund segment 12 further comprises a semirigid belt portion 34 having an enclosed end 36 slidably received within the pocket 26 in a manner that a body of the belt portion 34 extends out of the open end 28 of the pocket 26 and the belt portion 34 may slide back-and-forth within the pocket 26 in a longitudinal direction 30. Belt portion 34 may be provided with a plurality of apertures such as holes 39 along its length to provide venting for airflow. Preferably semirigid belt portion 34 is made of a thermoplastic and provides suitable rigidity to limit sagging of the belt portion when other accessories or equipment are attached to the belt portion, such as for example, firearms, body armor, ammunition pouches, radios, or other tactical or outdoor equipment. The term "semirigid" when used in conjunction with the belt portion herein means that the belt portion is rigid to resist sagging vertically but has sufficient flexibility to be curved along its length to enable the belt portion to curve along a wearer's waist.

Cummerbund segment 12 further comprises an elastic member 38 that connects the enclosed end 36 of the belt portion 34 to the closed end 32 of the pouch 18. The elastic member 38 may be an elastic webbing or other form of elastic and is operable to expand in response to a pulling force applied to the belt portion along the longitudinal direction 30 to permit partial extraction of the enclosed end 36 of the belt portion 34 from the pocket 26, and to contract on withdrawal of the pulling force to pull the enclosed end back into the pocket. Hence the elastic member 38 biases the enclosed end 36 of the belt portion 34 to be received within the pouch 18 in the absence of a force tending to pull the enclosed end 36 out of the pocket 26. The elastic member 38 may be stitched to both the enclosed end 36 of the belt portion 34 and the closed end 32 of the pouch 18 or it may be in some other suitable manner so attached. The pulling force may be provided during use by an expansion of the wearer's waist as a result of movement by the wearer. Accordingly, the cummerbund 10 allows for expansion of the overall length of the cummerbund during use to accommodate the wearer's movement and thereby avoid unnecessary constriction of the wearer's waist and associated discomfort.

The pouch 18 of the cummerbund segment 12 further includes a first connector 42 on an outward facing surface of the first side panel 22. The first connector 42 is operable to removably connect the pouch 18 to the object 14. Preferably, first connector 42 is one of either the hooks or the loops of a hook and loop fastener and is operable to connect to the counterpart hooks or loops that may be provided on the object 14. Preferably, the pouch 18 further includes a second connector 44 on an outward facing surface of the second side panel 24 that is one of either the hooks or the loops of a hook and loop fastener, and preferably the second connector 44 has the opposite or counterpart (hooks or loops) to the first connector 42. Thus, for example, if the first connector 42 comprises the hooks then the second connector 44 may comprise the loops, and vice versa. This enables the pouch 18 to be connected to an object having one of either hooks or loops thereon since the pouch 18 includes both sets of hooks and loops, one on each side panel. In such embodiments, the pouch 18 may be made with hook and loop fastener components themselves with the backings thereof positioned back to back to form the pocket 26 and the hooks and loops facing outward to provide the first connector 42 and second connector 44.

Cummerbund segment 12 further includes a terminal end connector 46 on a terminal end 48 of the belt portion 34 operable to connect to the terminal end connector 46 of the other segment 12 in a manner that allows the belt portions of both segments to extend around the wearer's waist. Preferably, the terminal end connectors 46 of both segments 12*a* and 12*b* together comprise a hook and loop type fastener that enables the terminal end connectors 46 to be conveniently and removably attached to each other.

In other embodiments, the terminal end connectors 46 of both segments 12*a* and 12*b* together may comprise a buckle 47 or some other mechanism by which the terminal end connectors may be attached to each other.

Referring to FIGS. 6-8 there is shown another embodiment of a cummerbund of the present invention having cummerbund segments 112*a* and 112*b* on which the first or second connectors on the pouch 118 comprise attachment straps 162 that originate from an edge of the pouch 118 and webbing loops 164 that are provide on the first side panel 122 on the pouch 118 and are configured to receive the straps 162. The webbing loops 164 are arranged in several rows such that the loops are in vertical alignment. This embodiment is adapted to attach to an object 14 having similarly configured and complementary layout of webbing loops 172 through which the straps 162 are able to be passed. Examples of such attachment straps systems are commonly referred to in the tactical and outdoor equipment fields of art as MOLLE (Modular Lightweight Load-carrying Equipment) or PALS (Pouch Attachment Ladder System) webbing, and the skilled reader knowledgeable with these fields would be familiar with such attachment systems. Briefly, as shown in FIG. 8, with the panel 122 of the pouch 118 being in proximity to the complementary loops 172 on the object 14, the rows of loops 164 on the pouch are aligned in between the rows of loops 172 on the object. The straps 162 are then alternatingly threaded through a loop 172 on the object, then a loop 164 on the pouch, then again a loop 172 and then a loop 164, and so on until all of the straps have been threaded through all of the loops. The straps 162 are drawn taut and each terminal end 166 of the straps is threaded back up into a loop or in some other manner secured, such as for example by a snap, button or the like. Once all straps 162 are threaded through the corresponding vertical alignment of loops, both on the pouch 118 and the object, then the pouch is thereby removably attached to the object. Removal may be accomplished by loosening the terminal ends 166 and removing the straps 162 from the webbing loops 164 on the pouch and webbing loops 172 on the object.

Accordingly, a cummerbund of the present invention may be removable connected to an object to be carried, such as a backpack, body armor, tactical vest, tactical radio, and the like, that typically have or can be provided with some form of connector mechanism, such as one portion of hook and loop fastener (as with cummerbund segment 12) or MOLLE/PALS webbing (as with cummerbund segment 112), and the cummerbund secures the object around the wearer's waist. The semirigid belt portion provides sufficient rigidity to enable the cummerbund to support the weight of the object, and other accessories or equipment attached thereto, without sagging, yet the elastic member provides flexibility to the cummerbund to enable it to longitudinally expand to accommodate slight variations of the wearer's waistline consequent to movement for additional comfort.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A cummerbund for removably attaching to an object to be carried in a manner for securing the object to a wearer's waist, the cummerbund comprising two segments wherein each segment comprises:

an attachment member having a first side panel and an opposite second side panel that is connected to the first side panel to define a pocket between said side panels, the pocket includes an open end and an opposite closed end;

a semirigid belt portion having an enclosed end slidably received within the pocket in a manner that a body of the belt portion extends out of the open end of the pocket, the belt portion having a terminal end remote from the enclosed end that includes a terminal end connector operable to connect to the terminal end connector of the other segment in a manner that allows the belt portions of both segments to extend around the wearer's waist;

an elastic member connecting the enclosed end of the belt portion to the closed end of the pocket, wherein the elastic member expands in response to a pulling force applied to the belt portion to permit partial extraction of the enclosed end of the belt portion from the pocket, and to contract on withdrawal of the pulling force to pull the enclosed end back into the pocket;

a first connector on an outward facing surface of the first side panel operable to removably connect the attachment member to the object wherein the first connector comprises one of hooks and loops of a hook and loop fastener; and a second connector on an outward facing surface of the second side panel wherein the second connector comprises one of hooks and loops of a hook and loop fastener.

2. The Cummerbund as claimed in claim 1, wherein the second connector is a counterpart to the first connector.

3. The Cummerbund as claimed in claim 2, wherein the terminal end connector comprises one or both of hooks and loops of a hook and loop fastener.

4. The Cummerbund as claimed in claim 1, wherein the terminal end connectors of both segments together comprise a buckle.

5. The Cummerbund as claimed in claim 1, wherein the attachment member comprises a fabric pouch, and the elastic member is stitched to both the enclosed end of the belt portion and the closed end of the pocket.

6. A vest or body armor having a cummerbund as claimed in claim 1.

* * * * *